US005285965A

United States Patent [19]

McCutcheon et al.

[11] Patent Number: 5,285,965

[45] Date of Patent: Feb. 15, 1994

[54] SPRAY TIP GUARD FOR AIR-ASSISTED AIRLESS SPRAY GUN

[75] Inventors: Tera D. McCutcheon, Coon Rapids; Stanley G. Karwoski, Oakdale; Timothy L. Mullen, Champlin, all of Minn.

[73] Assignee: Graco Inc., Golden Valley, Minn.

[21] Appl. No.: 992,546

[22] Filed: Dec. 17, 1992

[51] Int. Cl.[5] ..... B05B 1/28

[52] U.S. Cl. ..... 239/288; 239/Dig. 22

[58] Field of Search ..... 239/288, 288.3, 288.5, 239/DIG. 22, 119

[56] References Cited

U.S. PATENT DOCUMENTS

| | | | |
|---|---|---|---|
| 3,952,955 | 4/1976 | Clements | 239/288.5 |
| 4,025,045 | 5/1977 | Kubiak | 239/288.5 |
| 4,036,438 | 7/1977 | Soderlind et al. | 239/288.5 |
| 4,074,857 | 2/1978 | Calder | 239/119 |
| 4,116,386 | 9/1978 | Calder | 239/119 |
| 4,165,836 | 8/1979 | Eull | 239/119 |
| 4,181,261 | 1/1980 | Crum | 239/288.5 |
| 4,239,157 | 12/1980 | Fasth | 239/288.5 |
| 4,331,296 | 5/1982 | Levey | 239/288 |
| 4,483,481 | 11/1984 | Calder | 239/119 |
| 4,508,268 | 4/1985 | Geberth, Jr. | 239/119 |
| 4,513,913 | 4/1985 | Smith | 239/119 |
| 4,516,724 | 5/1985 | Hellman | 239/119 |
| 4,635,850 | 1/1987 | Leisi | 239/119 |
| 4,637,551 | 1/1987 | Seeger, Jr. et al. | 239/288.5 |
| 4,685,621 | 8/1987 | Scherer et al. | 239/288 |
| 4,700,890 | 10/1987 | Hasegawa | 239/288.5 X |
| 4,715,537 | 12/1987 | Calder | 239/119 |

*Primary Examiner*—Andres Kashnikow
*Assistant Examiner*—Lesley D. Morris
*Attorney, Agent, or Firm*—Palmatier, Sjoquist & Helget

[57] ABSTRACT

A tip guard is provided to protect a user of an air-assisted airless paint spray gun from injury. The shape of the tip guard is designed such that use of the tip guard is not detrimental to the fluid spray pattern emitted from the tip of the air-assisted airless paint spray gun. Use of the tip guard does not affect the size or shape of the fluid spray pattern, nor cause accumulation of paint upon the tip guard. The tip guard has a base having a shoulder and an aperture adapted for engagement to the air cap and tip of an air-assisted airless paint spray gun. The base further has a pair of transition portions extending axially forward from said aperture, where notches formed in the transition portions are adapted to engage the forwardly-extending horns of the air cap of an air-assisted airless paint spray gun. Each transition portion further has a pair of vanes extending forwardly and radially outwardly from the transition portion, where each of said pair of vanes is then joined by a crossbar.

24 Claims, 1 Drawing Sheet

SPRAY TIP GUARD FOR AIR-ASSISTED AIRLESS SPRAY GUN

BACKGROUND OF THE INVENTION

The present invention relates to a device for use with an air-assisted airless paint spray gun to protect a user from injury while simultaneously preventing accumulation of paint upon, and dripping from, the tip guard.

Air-assisted airless paint spray guns and tip guards have been known and used for many years. An example is disclosed in the Scherer et al U.S. Pat. No. 4,685,612. Spray paint guns have always been somewhat hazardous due to the high pressures involved during ejection of paint. Accidental injection of fluid to an operator is possible if a painter should place the spray tip too close to a body part.

The face of the gun, i.e., the air cap/tip combination of an air-assisted airless paint spray gun creates a unique problem deterring use of a conventional tip guard for the protection of painters. Typically, the air cap surrounding the tip of an air-assisted airless paint spray gun has at least two forwardly-extending horns and a plurality of air apertures surrounding a centrally-positioned paint aperture. The face of the gun, i.e., the tip and cap are required to remain free of obstructions during use. The tip guards as known are unable to be used in conjunction with the air cap due to the existence of the forwardly-extending horns and obstruction of the plurality of air apertures.

Another problem involves the prevention of accumulation of paint upon a guard during spraying while simultaneously minimizing the obstruction of the air and paint apertures. Prevention of accumulation of paint upon a tip guard substantially reduces and/or eliminates the dripping of paint off the guard and avoids splattering of paint and/or other resulting imperfections forming upon a painted surface.

Known prior art tip guards have a construction such that the tip guards will accumulate paint to the point of dripping in under five minutes. The striking improvement provided by the tip guard of the instant invention allows spraying for hours at a time without objectionable paint buildup.

SUMMARY OF THE INVENTION

A tip guard is provided to protect a user of an air-assisted airless paint spray gun from injury. The tip guard also prevents accumulation and dripping of paint during use. The tip guard has a base having a shoulder and an aperture adapted for engagement to the air cap retaining ring of an air-assisted airless paint spray gun. The base further has a pair of transition portions extending axially forward from said aperture, where notches formed in the transition portions are adapted to engage the forwardly-extending horns of the air cap of an air-assisted airless paint spray gun. Each transition portion further has a pair of vanes extending forwardly and radially outwardly from the transition portion, where each of said pair of vanes is then joined by a crossbar.

An object of this invention is to provide a tip guard which provides substantially the physical protection, and warning to a user, as provided by prior art devices. It is further an object of this invention to provide a tip guard which tends to resist accumulation of paint during spraying, thereby removing the incentive for the painter to attempt to remove the tip guard.

It is a further object of the invention to interface securely and conveniently with the face of an air-assisted airless paint spray gun having forwardly-extending horns, and a plurality of air apertures, without obstructing the aerodynamic ejection and interaction of paint and air from a system.

Still another object of the invention is to provide a tip guard for use with an air-assisted airless paint spray gun of relatively simple and inexpensive design, construction, and operation, which is safe and durable and which fulfills the intended purpose without injury to persons and/or damage to property.

Still another object of the invention is to not interfere with the air and paint apertures traversing the face of the tip of an air-assisted airless paint spray gun.

Still another object of the invention is to securely and rigidly affix the base of the invention to an air cap retaining ring of an air-assisted airless paint spray gun by applying heat to the base of the invention, causing pliable expansion thereof, engaging the base over the retaining ring, and then applying cold or removing heat to facilitate natural cooling and rigid contracting attachment of the base of the tip guard to the retaining ring of the air-assisted airless paint spray gun.

Still another object of the invention is to key the transition portions of the invention to the horns of the air cap of the air-assisted airless paint spray gun and to assure their relative orientation.

Still another object of the invention is to maintain the structural integrity and stability of the base and transition portions following the addition of the notches.

A feature of the invention includes a base having a shoulder, an aperture and an opposite pair of transition portions for flush and sturdy engagement over the face of the air cap of the air-assisted airless paint spray gun.

Another feature of the invention is a notch centrally located in each transition portion adapted for recessed receiving engagement of a horn of the air cap of an air-assisted airless paint spray gun.

Still another feature of the invention is the substantially elongate rectangular shape of the aperture having opposite edges where the aperture is adapted to eliminate interference with the air and paint apertures of the tip and air cap located on the face of the air-assisted airless paint spray gun.

Still another feature of the invention is the substantially parallel alignment of the elongate rectangular aperture with respect to the crossbars.

DETAILED DESCRIPTION OF THE PREFERRED EMBODIMENT

Figure 1:
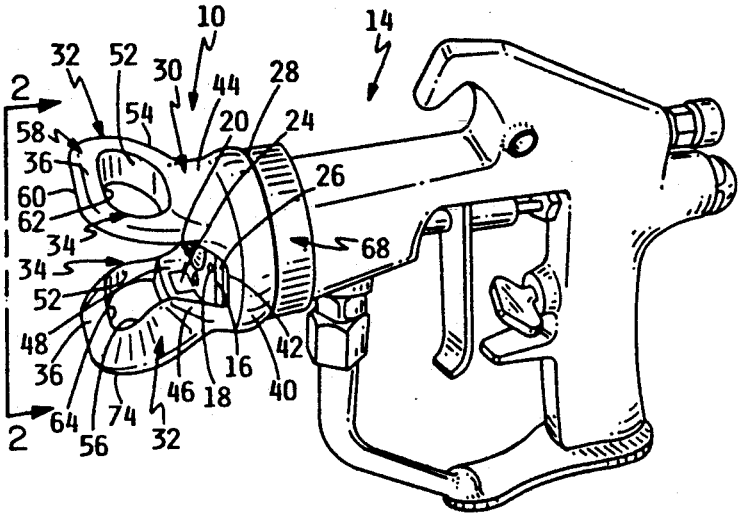
FIG. 1 is an isometric view of the tip guard affixed to an air-assisted airless paint spray gun.

One form of the invention is illustrated and described herein. The tip guard is indicated in general by the numeral 10. The tip guard 10 is designed for permanent attachment to the retaining ring 68, and assembly with, the air cap of an air-assisted airless paint spray gun. The air cap is indicated in general by the numeral 12 and the air-assisted airless paint spray gun is indicated in general by the numeral 14.

The air cap 12 generally has a face 16 having a plurality of air apertures 18, the associated tip 70 has a paint aperture 20 and the retaining ring 68 has at least one groove 22. In addition, the face 16 has at least two oppositely-aligned horns 24 projecting substantially forwardly from said face 16. The plurality of air apertures 18 and the paint aperture 20 are required to remain free and clear of obstructions during use of the air-assisted airless paint spray gun 14 in order to maintain the preferred aerodynamic atomization of paint ejected from the tip 70.

Figure 2:
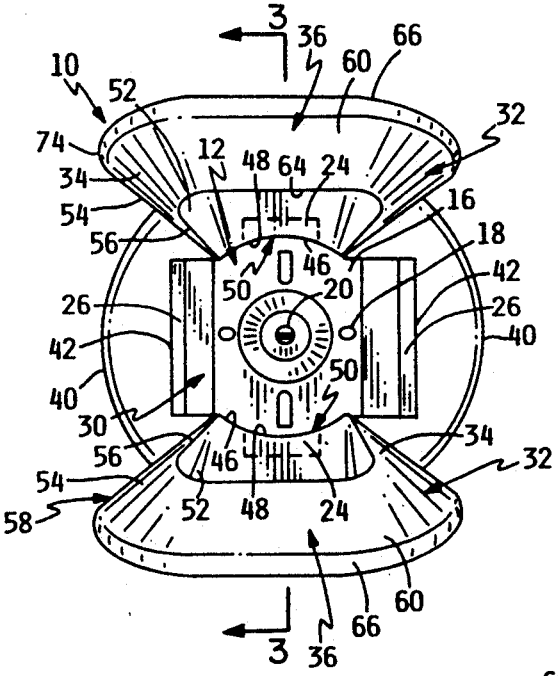
FIG. 2 is a front, partial phantom line view of the tip guard taken along the line 2—2 of FIG. 1.

The face 16 of the air cap 12 is generally flat having depending exterior edge portions 26. The generally flat surface of the face 16 contains the air apertures 18 and an opening through tip 70 which contains the paint aperture 20 (FIG. 2).

The tip guard 10 is molded of a generally non-breakable material, such as nylon; the term non-breakable meaning not easily manually broken off the gun by a painter.

A pair of oppositely-aligned transition portions 30 extend generally forwardly from a base 28. A pair of wing members 32 extend generally forwardly and outwardly from the transition portions 30, each wing member 32 being formed by a pair of vanes 34 and a crossbar 36. Both vanes 34 and crossbar 36 are generally V-shaped having cross sections more fully described hereinafter.

Figure 3:
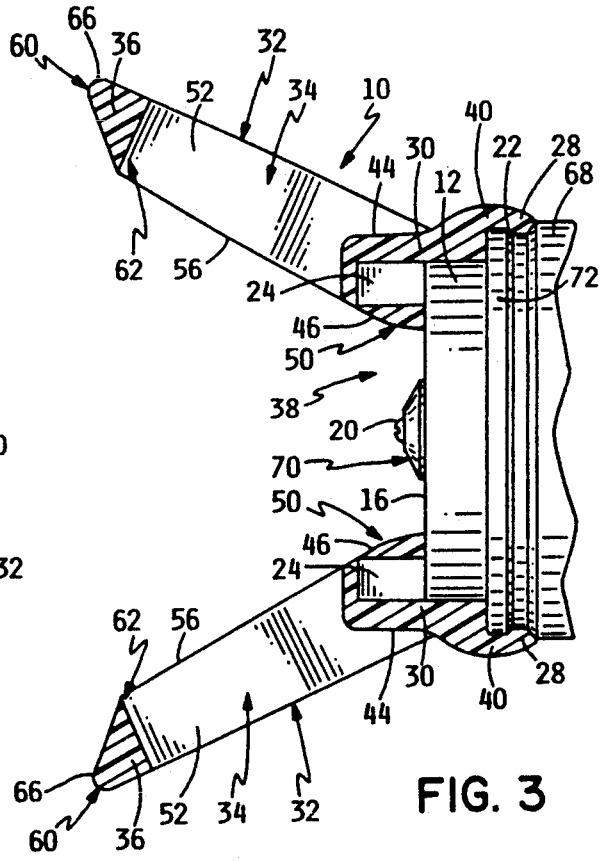
FIG. 3 is a cross section side view of the tip guard taken along the line 3—3 of FIG. 2.

In addition to the pair of transition portions 30, the base 28 includes an aperture 38 and a shoulder 40. The base 28 is preferably adapted for fixed locking engagement to the grooves 22 of the retaining ring 68 (FIG. 3).

The shoulder 40 is generally circular defining a raised ridge encircling the air cap 12. The shoulder 40 joins the pair of transition portions 30 to the base 28, proximal to the exterior edge of face 16. The shoulder 40 preferably is located exterior to, and on top of, the grooves 22 of the retaining ring 68. The interior of the shoulder 40 is preferably in rigid locking engagement to the grooves 22 of the retaining ring 68 (FIG. 3). The shoulder 40 in conjunction with the base 28 provides the mechanism for rigid permanent affixation of the tip guard 10 to the retaining ring 68 of an air-assisted airless paint spray gun 14. The shoulder 40 following locking engagement to the grooves 22 prevents the forward removal of the tip guard 10 from the retaining ring 68.

The aperture 38 of the tip guard 10 traverses the base 28. The aperture 38 is generally rectangular in shape surrounding the face 16 and the depending exterior edge portions 26 of the air cap 12. The aperture 38 does not obstruct or interfere with the aerodynamic operation of the air cap 12 of the air-assisted airless paint spray gun 14 during painting. The aperture 38 contains a pair of opposite edges 42 which preferably abut the depending contour of the exterior edge portions 26 of the face 16. The opposite edges 42 are preferably interior of the shoulder 40, and join the interior of the shoulder 40.

The aperture 38 preferably provides an open area for ejectment of air to atomize paint emitted from the paint aperture 20, while simultaneously minimizing positional interference of the remaining elements and features of the tip guard 10.

The pair of transition portions 30 contain exterior and interior surfaces 44 and 46, respectively. The pair of transition portions 30 preferably extend forwardly from the base 28. The pair of transition portions 30 are preferably aligned and centrally located on opposite sides of the aperture 38 equal distances between the opposite edges 42. The pair of transition portions 30 join the wing members 32 to the shoulder 40 of the base 28.

Each interior surface 46 of the pair of transition portions 30 has an aligned, centrally-positioned, curved depression 48. The curved depressions 48 are preferably also located equal distances between the opposite edges 42 (FIG. 2). Each curved depression 48 has a centrally-positioned notch 50 adapted for recessed, receiving engagement of the forwardly-projecting horns 24 of the face 16 of the air cap 12. The notches 50 do not affect or sacrifice the structural strength or integrity of the transition portions 30. Engagement between the notches 50 and projecting horns 24 does not interfere with the air apertures 18, paint aperture 20 or the aerodynamic atomization of paint emitted from the tip 70 during operation of the air-assisted airless paint spray gun 14. The notches 50 prevent the rotation of the tip guard 10 around the assembly of the tip 70 and the air cap 12.

Generally, the position of the interior surfaces 46 and the curved depressions 48 of the pair of transition portions 30 form a saddle shape with respect to the opposite edges 42 which join the shoulder 40.

A purpose of the pair of transition portions 30 is to provide a means for engagement of the tip guard 10 to the projecting horns 24 of the face 16, while simultaneously not interfering with the aerodynamics of the air or paint apertures 18, 20 during use of the air paint spray gun 14. Another purpose of the pair of transition portions 30 is to provide a resilient, sturdy and durable means for engagement of the wing members 32 to the shoulder 40 and base 28 of the tip guard 10.

The tip guard 10 is preferably affixed to the air cap 12 and retaining ring 68 of the air-assisted airless paint spray gun 14 by application of heat to base 28 and shoulder 40. The base 28 and shoulder 40 then preferably become resiliently pliable, whereon the tip guard 10 may be snapped over and seated behind the shoulder 72 of the retaining ring 68. The tip guard 10 is assembled to the air cap 12 and tip 70, such that the horns 24 are received by the notches 50 of the curved depressions 48 of the pair of transition portions 30. The tip guard 10 then flushly engages the face 16 of the air cap 12. The interior of the shoulder 40 preferably, simultaneously engages the grooves 22 of the retaining ring 68 (FIG. 3). Following engagement of the tip guard 10 to the retaining ring 68, heat may be removed to permit natural cooling of the tip guard 10, base 28 and shoulder 40. In the alternative, the tip guard 10 may be cooled to facilitate contraction and locking of the base 28 and shoulder 40 to the grooves 22 of the retaining ring 68. Preferably, when cooling of the base 28 and shoulder 40 to ambient temperature occurs, the tip guard 10 is resiliently and durably locked to the grooves 22 of the retaining ring 68. Removal of the tip guard 10 from the retaining ring 68 is thereby prevented.

Each vane 34 is formed with an inner surface 52 and an outer surface 54 which diverge radially outwardly from a sharp inner edge 56. While a small radius can be acceptable on edge 56, it is preferable that this edge 56 be sharp in order to more effectively prevent the buildup and accumulation of paint. The rounded rear portion 58 is provided on the outer side of each vane 34.

Each crossbar 36 is provided with an upper side 60 and a lower side 62 which diverge outwardly from an inner edge 64. A round outer surface 66 is also provided. A rounded area 74 provides a junction between the vanes 34 and the crossbar 36.

The tip guard 10 is preferably formed of Delrin TM, nylon or any other plastic or suitable material which is resiliently flexible, durable and resists breakage during normal use.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. An improved tip guard for use with an air-assisted airless paint spray gun, said air-assisted airless paint spray gun having a tip having a paint orifice, an air cap having an air spray face and at least two horns, and a retaining ring said improvement comprising:

a) a base having a shoulder, an aperture, and an opposite pair of transition portions extending axially forward from said aperture, each transition portion having a centrally-positioned notch adapted for receiving engagement of one of said horns of said air cap;

b) at least two vanes extending axially forwardly and radially outwardly from each of said transition portions and forming at least first and second pairs, each said vane having a distal end, a substantially sharp inner edge facing radially inwardly and inner and outer sides, said sides diverging outwardly from said inner edge, said inner sides being substantially curved proximal to said base; and c) at least two crossbars, each of said crossbars joining a pair of said vanes at said distal ends and each said crossbar having a substantially sharp inner edge facing inwardly, said tip guard being formed of material and dimensions sufficient to resist breakage during normal use, said crossbars having first and second sides, said first sides being substantially curved proximal to said pair of said vanes.

2. The tip guard according to claim 1, wherein said aperture has a substantially elongate rectangular shape having a pair of opposite edges.

3. The tip guard according to claim 2, wherein each of said transition portions has interior and exterior surfaces, each of said interior surfaces having a centrally-positioned curved depression.

4. The tip guard according to claim 3, wherein said notches are adapted for central recessed positioning in each of said opposite curved depressions.

5. The tip guard according to claim 4, wherein said pair of opposite edges and said opposite curved depressions of said opposite pair of transition portions are adapted to substantially resemble the shape of a saddle.

6. The tip guard according to claim 5, wherein said pair of opposite edges join said shoulder.

7. The tip guard according to claim 6, wherein said shoulder is curved.

8. The tip guard according to claim 7, wherein said shoulder is adapted for locking and rotatable engagement to said retaining ring of said air-assisted airless paint spray gun.

9. The tip guard according to claim 8, wherein said shoulder is first adapted for pliable expansion and engagement to said retaining ring upon exposure to heat, said shoulder is further adapted for rigid locking contraction to said retaining ring of said air-assisted airless paint spray gun upon removal of heat.

10. The tip guard according to claim 9, wherein said aperture is adapted for receiving engagement of said air cap, said aperture further adapted to substantially surround said air cap without interfering with paint emanating from said paint orifice.

11. The tip guard according to claim 10, wherein said aperture is substantially parallel to said crossbars.

12. The tip guard according to claim 11, wherein said notches are adapted for recessed receiving engagement of said horns of said air cap.

13. The tip guard according to claim 12, wherein said notches are adapted to not impair the structural integrity of said transition portions.

14. The tip guard according to claim 13, wherein said opposite pair of transition portions are formed of resiliently-flexible material sufficient to resist breakage during normal use.

15. An improved tip guard for use with an air-assisted airless paint spray gun, said air-assisted airless paint spray gun having an air cap having a tip, a spray face, at least two horns, a paint orifice, and a retaining ring, said improvement comprising:

a) a base defining a shoulder, said base further defining an aperture, said aperture having a substantially elongate rectangular shape having a pair of opposite edges, said base further having an opposite pair of transition portions extending axially forwardly from said aperture, said transition portions having interior and exterior surfaces, each of said interior surfaces having a centrally-positioned opposite curved depression, each of said opposite curved depressions having a centrally-positioned notch adapted for receiving engagement of one of said horns of said air cap of said air-assisted airless paint spray gun, said opposite pair of edges and said opposite curved depressions of said transition portions positioned to substantially resemble the shape of a saddle, said opposite pair of edges further adapted to join said shoulder;

b) at least four vanes extending axially forwardly and radially outwardly from each of said transition portions and forming at least first and second pairs, each said vane having a distal end, a substantially sharp inner edge facing radially inwardly and inner and outer sides, said sides diverging outwardly from said inner edge, said inner sides being substantially curved proximal to said base; and c) at least two crossbars, each of said crossbars joining a pair of said vanes at said distal ends, each said crossbar having a substantially sharp inner edge facing inwardly, said tip guard being formed of material and dimensions sufficient to resist breakage during normal use, said crossbars having first and second sides, said first sides being substantially curved proximal to said pair of vanes.

16. The tip guard according to claim 15, wherein said shoulder is curved.

17. The tip guard according to claim 16, wherein said shoulder is adapted for locking and rotatable engagement to said retaining ring of said air-assisted airless paint spray gun.

18. The tip guard according to claim 17, wherein said shoulder is first adapted for pliable expansion and engagement to said retaining ring upon exposure to heat, said shoulder is further adapted for rigid locking contraction to said retaining ring of said air-assisted airless paint spray gun upon removal of heat.

19. The tip guard according to claim 18, wherein said aperture is adapted for receiving engagement of said air cap spray face, said aperture further adapted to substantially surround said air cap spray face without interfering with paint emanating from said paint orifice.

20. The tip guard according to claim 19, wherein said aperture is substantially parallel to said crossbars.

21. The tip guard according to claim 20, wherein said notches are adapted for recessed receiving engagement of said horns of said air cap mounted on said paint spray gun.

22. The tip guard according to claim 21, wherein said notches are adapted to not impair the structural integrity of said transition portions.

23. The tip guard according to claim 22, wherein said opposite pair of transition portions are formed of resiliently-flexible material sufficient to resist breakage during normal use.

24. The tip guard according to claim 23, wherein said tip guard is oriented to said air cap, said air cap is oriented to said tip, said air cap and said tip guard being aligned to not interfere with liquid being emitted from said tip.

* * * * *